US012078054B2

(12) United States Patent
Yin et al.

(10) Patent No.: US 12,078,054 B2
(45) Date of Patent: Sep. 3, 2024

(54) EXPERIMENTAL DEVICE AND METHOD FOR CO-EXISTENCE OF OVERFLOW AND LOST CIRCULATION IN FRACTURED FORMATION DURING DRILLING OF DEVIATED WELL

(71) Applicant: CHINA UNIVERSITY OF PETROLEUM (EAST CHINA), Dongying (CN)

(72) Inventors: Bangtang Yin, Dongying (CN); Chi Zhang, Dongying (CN); Baojiang Sun, Dongying (CN); Zhiyuan Wang, Dongying (CN); Xuliang Zhang, Dongying (CN); Yonghai Gao, Dongying (CN); Xiaohui Sun, Dongying (CN); Wei Zhang, Dongying (CN)

(73) Assignee: CHINA UNIVERSITY OF PETROLEUM (EAST CHINA), Dongying (CN)

( * ) Notice: Subject to any disclaimer, the term of this patent is extended or adjusted under 35 U.S.C. 154(b) by 0 days.

(21) Appl. No.: 18/599,325

(22) Filed: Mar. 8, 2024

(65) Prior Publication Data

US 2024/0209727 A1 Jun. 27, 2024

(30) Foreign Application Priority Data

Mar. 13, 2023 (CN) ..... 202310235636.3

(51) Int. Cl.
*E21B 47/10* (2012.01)

(52) U.S. Cl.
CPC ..... *E21B 47/10* (2013.01); *E21B 2200/20* (2020.05)

(58) Field of Classification Search
CPC ..... E21B 47/10; E21B 2200/20
See application file for complete search history.

(56) References Cited

FOREIGN PATENT DOCUMENTS

| | | | |
|---|---|---|---|
| CA | 2011831 | A1 | 9/1990 |
| CN | 104747187 | A | 7/2015 |
| CN | 106640061 | A | 5/2017 |
| CN | 206256908 | U | 6/2017 |
| CN | 206421746 | U | 8/2017 |
| CN | 112360390 | A | 2/2021 |
| CN | 113640473 | A | 11/2021 |
| CN | 115628032 | A | 1/2023 |
| WO | 2018103426 | A1 | 6/2018 |

OTHER PUBLICATIONS

Gang Shu, "Coexistence flow law and modeling of drilling spills in fractured formations", Excellent Master's Thesis, Southwest Petroleum University, No. 3, Mar. 15, 2015, pp. 27-30, 45-50.

*Primary Examiner* — Tarun Sinha

(57) ABSTRACT

An experimental device and method for co-existence of overflow and lost circulation in a fractured formation during drilling of a deviated well are provided. An inner cavity of an outer pipe is provided with an inner pipe to form a deviated casing. An upper side of the outer pipe is provided with a mixture outlet. A middle-lower side of the outer pipe is provided with a leakage port and two overflow ports. The gap width can be changed by adjusting a bolt and a support block to be compatible with different types of fracture models. A gas injection system includes an air compressor and a gas flowmeter. An upper port of a liquid injection system is connected to a joint arranged at upper ends of the inner pipe and outer pipe through a water pump, a liquid flowmeter and a liquid regulating valve.

1 Claim, 4 Drawing Sheets

EXPERIMENTAL DEVICE AND METHOD FOR CO-EXISTENCE OF OVERFLOW AND LOST CIRCULATION IN FRACTURED FORMATION DURING DRILLING OF DEVIATED WELL

CROSS-REFERENCE TO RELATED APPLICATIONS

This application claims the benefit of priority from Chinese Patent Application No. 202310235636.3, filed on Mar. 13, 2023. The content of the aforementioned application, including any intervening amendments thereto, is incorporated herein by reference in its entirety.

TECHNICAL FIELD

This application relates to oil and gas development, and more particularly to an experimental device and method for co-existence of overflow and lost circulation in a fractured formation during drilling of a deviated well.

BACKGROUND

With the continuous expansion of exploration and development of oil and gas resources in China, the drilling technologies and devices have been continuously improved, and more and more highly-deviated wells have been rapidly drilled in individual exploration blocks. Many structures involve narrow pressure window and high sensitivity of the formation to pressure coefficient in the same open hole interval, which leads to the presence of different pressure windows in the same open hole interval, and makes it prone to simultaneous overflow and lost circulation. Moreover, the existence of highly-deviated well sections will increase the contact surface between a borehole and the formation, which will exacerbate the possible lost circulation.

The co-existence of the lost circulation and overflow will make the lost circulation and overflow more complicated, and the alone use of the lost circulation treatment method or the overflow treatment method often fails to produce the desired effect. With regard to the underbalanced drilling, the lost circulation can be effectively alleviated or avoided by keeping the wellbore pressure lower than the formation pressure, and for the managed pressure drilling, the wellbore pressure is kept in a near-balanced state to avoid overflow and serious lost circulation. However, for a formation with a negative safety density window and a formation with multiple pressure systems in the open hole interval, they still face a risk of co-existence of lost circulation and overflow.

The co-existence of overflow and lost circulation in a fractured formation is a major problem in the drilling engineering, and has not been completely solved yet. For those fractured formations with occurrence conditions, it is hard to avoid the complex co-existence of overflow and lost circulation, and therefore it is necessary to study the law of such situation to take appropriate treatment measures.

Therefore, it is needed to design an experimental device and method for simulating the co-existence of overflow and lost circulation in a fractured formation during the process of drilling a deviated well.

SUMMARY

In view of the above defects in the prior art, this application provides an experimental device and method for co-existence of overflow and lost circulation in a fractured formation during drilling of a deviated well, in which key parameters of overflow and lost circulation processes in the wellbore and stratum under the co-existence of overflow and lost circulation in the fractured formation can be obtained by simulation, so as to provide theoretical basis for controlling the co-existence of overflow and lost circulation and effectively implementing the plugging and well killing, and ensure the drilling safety.

The present disclosure provides an experimental device for co-existence of overflow and lost circulation in a fractured formation during drilling of a deviated well, comprising:

a simulated deviated wellbore unit;

a computer data processing system;

a simulated formation fracture unit;

a gas injection system; and a liquid injection system;

wherein the simulated deviated wellbore unit comprises an outer pipe, an inner pipe, a joint, a drill bit, a mixture outlet, an upper overflow port, a leakage port, and a lower overflow port; an inner cavity of the outer pipe is provided with the inner pipe to form a deviated casing; the joint is arranged at an upper end of the outer pipe and an upper end of the inner pipe; a lower end of the inner pipe is provided with the drill bit; a lower end of the outer pipe is provided with a plug; an upper side of the outer pipe is provided with the mixture outlet; a middle and lower side of the outer pipe is provided with the leakage port; and a middle of the outer pipe is provided with the upper overflow port and the lower overflow port;

the simulated formation fracture unit comprises a support block, a sealing gasket, a first liquid flowmeter, a lost liquid collection tank, two clamp plates, a fracture model, and a bolt; the two clamp plates are connected through the bolt and the support block, and a gap is formed between the two clamp plates; the bolt and the support block are configured to be adjusted to change a width of the gap; the fracture model is provided in the gap, and a plurality of fractures are provided in the fracture model; the sealing gasket is provided between an upper surface of the fracture model and each of the two clamp plates; an upper side of each of the two clamp plates is provided with a first pipeline and a second pipeline; the first pipeline is connected to the lost liquid collection tank through the first liquid flowmeter, and the second pipeline is connected to the leakage port through a first back pressure valve; and an inner end of the first pipeline and an inner end of the second pipeline are respectively communicated with the plurality of fractures in the fracture model;

the gas injection system comprises an air compressor and a gas flowmeter; and an outlet end of the air compressor is connected to the upper overflow port and the lower overflow port through the gas flowmeter and a third pipeline;

the liquid injection system comprises a liquid storage tank, a water pump, a second liquid flowmeter, and a liquid regulating valve; the joint is connected with a water inlet elbow through a fourth pipeline; a top of the liquid storage tank is provided with a first connection port for liquid discharge, and a bottom of the liquid storage tank is provided with a second connection port for liquid injection; the first connection port is connected to the joint through the water pump, the second liquid flowmeter, and the liquid regulating valve; and the second connection port is connected to the mixture outlet through a gas-liquid separator.

In an embodiment, the fracture model comprises a model shell, the plurality of fractures, a liquid outlet, a liquid inlet, and a communicating groove; the model shell has a cuboid structure, and each of the plurality of fractures is strip-shaped; an inner cavity of the fracture model is provided with the plurality of fractures and the communicating groove perpendicularly connected with the plurality of fractures; an upper wall of the model shell is provided with the liquid outlet and the liquid inlet, and the liquid outlet and the liquid inlet are respectively connected with the communicating groove.

In an embodiment, the plurality of fractures each have a width of 1 mm, 3 mm, or 5 mm; and the number of the plurality of fractures is 5, 10 or 20.

In an embodiment, an outer wall of a fifth pipeline connected with the liquid outlet and an outer wall of a sixth pipeline connected with the liquid inlet are respectively provided with a pressure gauge.

In an embodiment, an annular space formed between the outer pipe and the inner pipe is provided with a pressure sensor, and the pressure sensor is connected to a computer system through a signal wire.

In an embodiment, an upper part of the joint is provided with the water inlet elbow; a lower end of the water inlet elbow is communicated with the inner pipe, and an upper end of the water inlet elbow is connected to the liquid regulating valve.

In an embodiment, an outlet end of the gas flowmeter of the air injection system is configured to be divided into two branches, one of the two branches is connected to the upper overflow port through a second back pressure valve; and the other of the two branches is connected to the lower overflow port through a third back pressure valve.

The present disclosure provides a use method for the experimental device for co-existence of overflow and lost circulation in a fractured formation during drilling of a deviated well, comprising:

(S1) opening the liquid regulating valve, and starting the water pump, so that water is pressurized by the water pump to successively fill a liquid injection pipeline, enter the inner pipe through the water inlet elbow, flow downward along the inner pipe to reach the drill bit, flow from bottom to top in the annular space formed between the outer pipe and the inner pipe, and flow out of the mixture outlet; and delivering an outflow from the mixture outlet to the gas-liquid separator for gas-liquid separation, wherein water is returned to the liquid storage tank for recycling;

(S2) after a flow pattern change in the liquid injection pipeline and a pressure change of the pressure sensor read by the computer system become stable, starting the air compressor and opening the first back pressure valve connected with the leakage port, so that gas, from the air compressor, sequentially flows through the gas flowmeter, the second back pressure valve, and the upper overflow port to enter the annular space between the outer pipe and the inner pipe so as to simulate an overflow situation occurring on an upper side of a formation; or the gas, sequentially flows through the gas flowmeter, the third back pressure valve, and the lower overflow port to enter the annular space between the outer pipe and the inner pipe so as to simulate an overflow situation occurring on a lower side of the formation;

(S3) opening the first back pressure valve connected with the leakage port, to allow a fluid in the annular space to the simulated formation fracture unit; wherein a type of the fracture model, the number of the plurality of fractures and width of the plurality of fractures are determined according to simulation needs, so as to simulate lost circulation situation in the formation under different fracture conditions; and the fluid eventually flows into the lost liquid collection tank;

(S4) opening the first back pressure valve, closing the second back pressure valve connected with the upper overflow port, and opening the third back pressure valve connected with the lower overflow port, so that the gas flows out of the lower overflow port to simulate a wellbore flow law and a formation lost circulation law under the co-existence of overflow and lost circulation in an upper lost circulation-lower overflow pattern;

(S5) opening the first back pressure valve, the second back pressure valve, and the third back pressure valve, such that the gas flows out from the upper overflow port and the lower overflow port, and leaks through the leakage port; obtaining, by the computer system, readings of the first liquid flowmeter, the second liquid flowmeter, the gas flowmeter, the pressure gauge, the first back pressure valve and the second back pressure valve, and analyzing a flow law and a formation lost circulation law under the co-existence of upper and lower overflow and lost circulation; and (S6) adjusting an opening of the first back pressure valve, the second back pressure valve, and the third back pressure valve to simulate a flow law under the co-existence of overflow and lost circulation in different formation conditions; changing inclined angles of the outer pipe and the inner pipe and repeating the above steps to simulate a law of co-existence of overflow and lost circulation in wells with different inclined angles.

Compared to the prior art, the present disclosure has the following beneficial effects.

(1) The present disclosure can simulate the co-existence of overflow and lost circulation in different patterns, such as upper overflow-lower lost circulation and upper lost circulation-lower overflow. The present disclosure can also simulate processes of simultaneous overflow and lost circulation in different fracture parameter conditions, such as fracture width, and the number of fractures. By changing pressure and fracture parameters, reliable experiment data can be provided for the control of co-existence of overflow and lost circulation in a fractured formation during the drilling of a deviated well.

(2) The device of the present disclosure is simple and easy to assemble. The outer pipe and the inner pipe of the simulated deviated wellbore unit are made of a transparent plexi-glass material. The simulated formation fracture unit adopts two thick clamp plates to clamp the fracture model, so as to form fractures with different widths and numbers. It has a good visualization effect on the simulation process of the co-existence of overflow and lost circulation in a fractured formation during the drill process of a deviated well, and offers a better simulation effect. Moreover, it also provides theoretical basis for effectively implementing the plugging and well killing, and ensures the safety of drilling.

Figure 1:
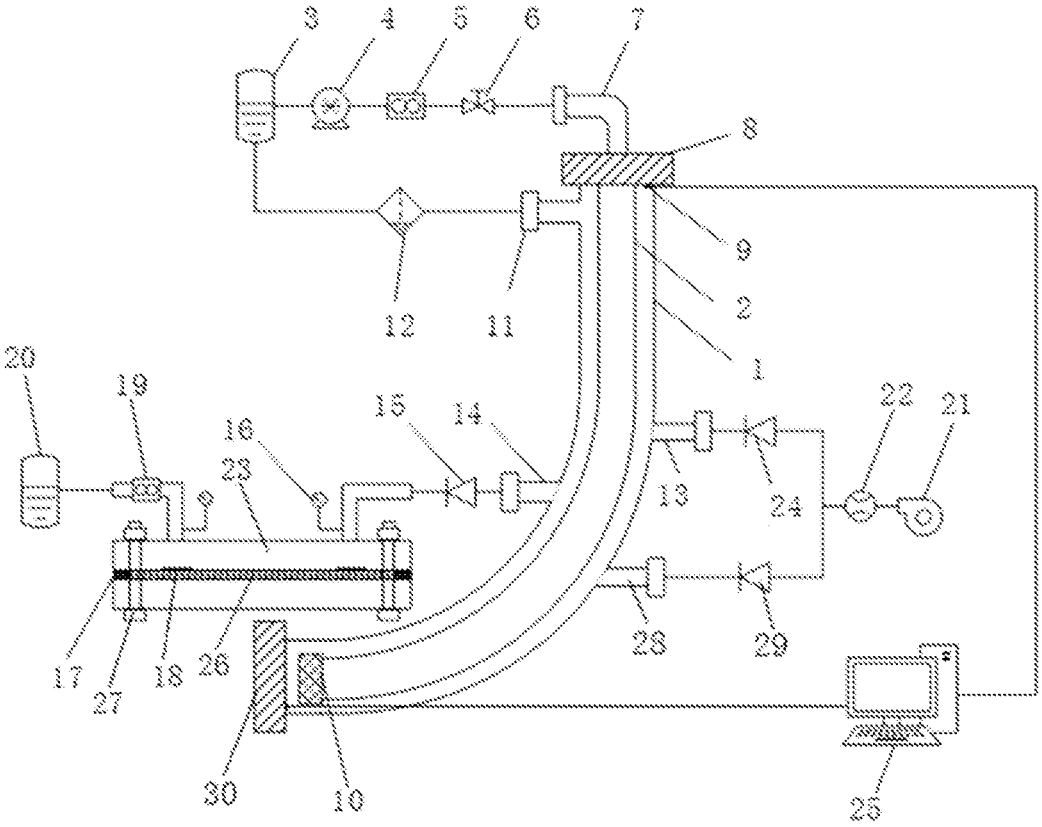
FIG. 1 schematically shows a whole structure of an experimental device according to an embodiment of the present disclosure.

In the figures: outer pipe 1; inner pipe 2; liquid storage tank 3; water pump 4; first liquid flowmeter 5; liquid regulating valve 6; water inlet elbow 7; joint 8; pressure sensor 9; drill bit 10; mixture outlet 11; gas-liquid separator 12; upper overflow port 13; leakage port 14; first back pressure valve 15; pressure gauge 16; support block 17; sealing gasket 18; second liquid flowmeter 19; lost liquid collection tank 20; air compressor 21; gas flowmeter 22; clamp plate 23; second back pressure valve 24; computer system 25; fracture model 26; bolt 27; lower overflow port 28; third back pressure valve 29; plug 30; model shell 26.1; fracture 26.2; liquid outlet 26.3; liquid inlet 26.4; and communicating groove 26.5.

DETAILED DESCRIPTION OF EMBODIMENTS

The present disclosure will be further described below with reference to the accompanying drawings and embodiments. It should be understood that the embodiments described herein are only to illustrate rather than limiting the present disclosure.

Embodiment 1

Referring to FIGS. 1-4, an experimental device for coexistence of overflow and lost circulation in a fractured formation during drilling of a deviated well is provided, including a simulated deviated wellbore unit, a computer data processing system, a simulated formation fracture unit, a gas injection system, and a liquid injection system.

The simulated deviated wellbore unit includes an outer pipe 1, an inner pipe 2, a joint 8, a drill bit 10, a mixture outlet 11, an upper overflow port 13, a leakage port 14, and a lower overflow port 28. An inner cavity of the outer pipe 1 is provided with the inner pipe 2 to form a deviated casing. The joint 8 is arranged at an upper end of the outer pipe 1 and an upper end of the inner pipe 2. A lower end of the inner pipe 2 is provided with the drill bit 10. A lower end of the outer pipe 1 is provided with a plug 30. An upper side of the outer pipe 1 is provided with the mixture outlet 11. A middle and lower side of the outer pipe 1 is provided with the leakage port 14. And a middle of the outer pipe 1 is provided with the upper overflow 13 port and the lower overflow port 28.

The simulated formation fracture unit includes a support block 17, a sealing gasket 18, a second liquid flowmeter 19, a lost liquid collection tank 20, two clamp plates 23, a fracture model 26, and a bolt 27. The two clamp plates 23 are connected through the bolt 27 and the support block 17, and a gap is formed between the two clamp plates 23. The bolt 27 and the support block 17 are configured to be adjusted to change a width of the gap. The fracture model 26 is provided in the gap, and a plurality of fractures 26.2 are provided in the fracture model 26. The sealing gasket 18 is provided between an upper surface of the fracture model 26 and each of the two clamp plates 23. An upper side of each of the two clamp plates 23 is provided with a first pipeline and a second pipeline. The first pipeline is connected to the lost liquid collection tank 20 through the second liquid flowmeter 19, and the second pipeline is connected to the leakage port 14 through a first back pressure valve 15. And an inner end of the first pipeline and an inner end of the second pipeline are respectively communicated with the plurality of fractures 26.2 in the fracture model 26.

The gas injection system includes an air compressor 21 and a gas flowmeter 22. And an outlet end of the air compressor 21 is connected to the upper overflow port 13 and the lower overflow port 28 through the gas flowmeter 22 and a third pipeline.

The liquid injection system includes a liquid storage tank 3, a water pump 4, a first liquid flowmeter 5, and a liquid regulating valve 6. The joint 8 is connected with a water inlet elbow 7 through a fourth pipeline. A top of the liquid storage tank 3 is provided with a first connection port for liquid discharge, and a bottom of the liquid storage tank 3 is provided with a second connection port for liquid injection. The first connection port is connected to the joint 8 through the water pump 4, the first liquid flowmeter 5, and the liquid regulating valve 6. And the second connection port is connected to the mixture outlet 11 through a gas-liquid separator 12.

Figure 2:
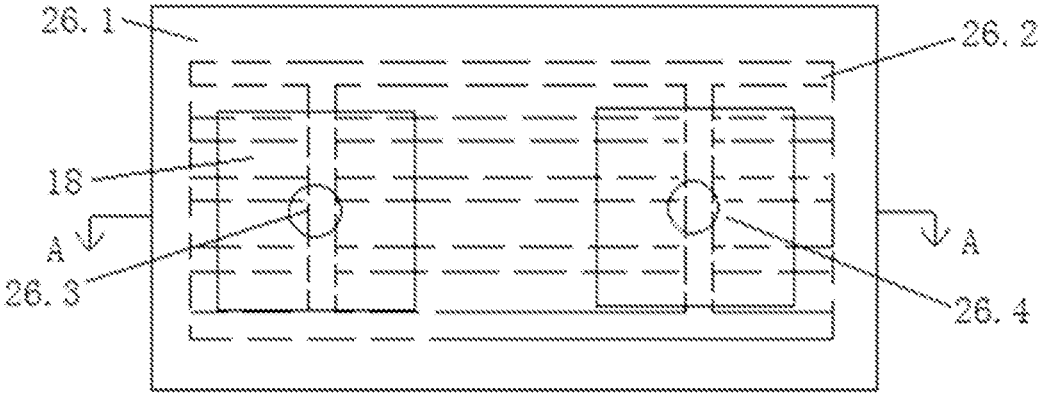
FIG. 2 is a top view of a simulated formation fracture unit with a sealing gasket at the upper side according to an embodiment of the present disclosure.
Figure 3:
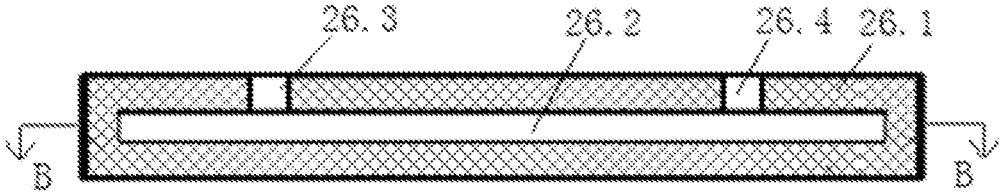
FIG. 3 schematically shows the simulated formation fracture unit in FIG. 2 along an A-A line.
Figure 4:
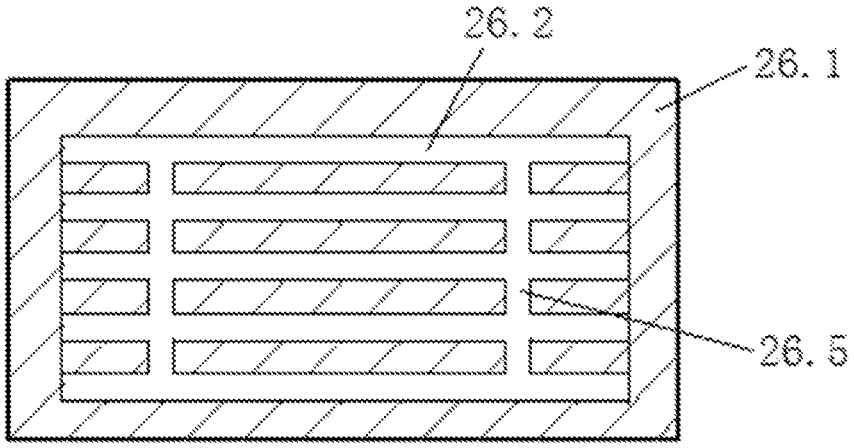
FIG. 4 is a sectional view of the structure in FIG. 3 along a B-B line.

In an embodiment, referring to FIGS. 2-4, the fracture model 26 includes a model shell 26.1, the plurality of fractures 26.2, a liquid outlet 26.3, a liquid inlet 26.4, and a communicating groove 26.5. The model shell 26.1 has a cuboid structure, and each of the plurality of fractures 26.2 is strip-shaped. An inner cavity of the fracture model 26 is provided with the plurality of fractures 26.2 and the communicating groove 26.5 perpendicularly connected with the plurality of fractures 26.2. An upper wall of the model shell 26.1 is provided with the liquid outlet 26.3 and the liquid inlet 26.4, the liquid outlet 26.3 and the liquid inlet 26.4 are respectively connected with the communicating groove 26.5.

In an embodiment, the plurality of fractures 26.2 each have a width of 1 mm, 3 mm, or 5 mm. And the number of the plurality of fractures 26.2 is 5, 10 or 20. Different types of fracture models 26 are used according to simulation needs, and each type of the fracture models 26 is provided with fractures with different number and widths.

In addition, an outer wall of a fifth pipeline connected with the liquid outlet 26.3 and an outer wall of a sixth pipeline connected with the liquid inlet 26.4 are respectively provided with a pressure gauge 16, which facilitates to measure pressure data.

An annular space formed between the outer pipe 1 and the inner pipe 2 is provided with a pressure sensor 9, and the pressure sensor 9 is connected to a computer system 25 through a signal wire.

An upper part of the joint 8 is provided with the water inlet elbow 7. A lower end of the water inlet elbow 7 is communicated with the inner pipe 2, and an upper end of the water inlet elbow 7 is connected to the liquid regulating valve 6. The present disclosure provides the fluid in simulation experiment processes through the liquid storage tank 3, and controls flows and pressure of the input fluid through adjusting an opening of the liquid regulating valve 6.

In an embodiment, an outlet end of the gas flowmeter 22 of the air injection system is configured to be divided into two branches. One of the two branches is connected to the upper overflow port 13 through a second back pressure valve 24, which is configured to control switch and flow regulation of the upper overflow port 13. The other of the two branches is connected to the lower overflow port 28 through a third back pressure valve 29, which is configured to control switch and flow regulation of the lower overflow port 28.

A use method for the experimental device for co-existence of overflow and lost circulation in a fractured formation during drilling of a deviated well includes the following steps.

(S1) The liquid regulating valve 6 is opened, and the water pump 4 is started, so that water is pressurized by the water pump 4 to successively fill a liquid injection pipeline enter the inner pipe 2 through the water inlet elbow 7 flow downward along the inner pipe 2 and to reach the drill bit 10, flow from bottom to top in the annular space formed between the outer pipe 1 and the inner pipe 2, and flow out of the mixture outlet 11. And an outflow is delivered from the mixture outlet 11 to the gas-liquid separator 12 for gas-liquid separation, wherein water is returned to the liquid storage tank 3 for recycling.

(S2) After a flow pattern change in the liquid injection pipeline and a pressure change of the pressure sensor 9 read by the computer system 25 become stable, the air compressor 9 is started and the first back pressure valve 15 connected with an outside of the leakage port 14 is opened, so that gas, from the air compressor 21, sequentially flows through the gas flowmeter 22, the second back pressure valve 24, and the upper overflow port 13 to enter the annular space between the outer pipe 1 and the inner pipe 2 so as to simulate an overflow situation occurring on an upper side of a formation. Or the gas sequentially flows through the gas flowmeter 22, the third back pressure valve 29, and the lower overflow port 28 to enter the annular space between the outer pipe 1 and the inner pipe 2 so as to simulate the overflow situation occurring on a lower side of the formation.

(S3) The first back pressure valve 15 connected with the leakage port 14 is opened to allow a fluid in the annular space to enter the simulated formation fracture unit, where a type of the fracture models 26, the number of the plurality of fractures and width of the plurality of fractures are determined are determined according to simulation needs, so as to simulate lost circulation situation in the formation under different fracture conditions. And the fluid eventually flows into the lost liquid collection tank 20.

(S4) The first back pressure valve 15 is opened, the second back pressure valve 24 connected with the upper overflow port 13 is closed, and the third back pressure valve 29 connected with the lower overflow port 28 is opened, so that the gas flows out of the lower overflow port 28 to simulate a wellbore flow law and a formation lost circulation law under the co-existence of overflow and lost circulation in an upper lost circulation-lower overflow pattern.

(S5) The first back pressure valve 15, the second back pressure valve 24, and the third back pressure valve 29 are opened, such that the gas flows out from the upper overflow port 13 and the lower overflow port 28, and leaks through the leakage port 14. Readings of the first liquid flowmeter 5, the second liquid flowmeter 19, the gas flowmeter 22, the pressure gauge 16, the first back pressure valve 15 and the second back pressure valve 24 are obtained by the computer system 25. And a flow law and a formation lost circulation law under the co-existence of upper and lower overflow and lost circulation are analyzed.

(S6) Openings of the first back pressure valve 15, the second back pressure valve 24, and the third back pressure valve 29 are adjusted to simulate a flow law under the co-existence of overflow and lost circulation in different formation conditions., Inclined angles of the outer pipe 1 and the inner pipe 2 are changed, and the above steps are repeated to simulated a law of co-existence of overflow and lost circulation of in wells with different inclined angles.

Described above are only preferred embodiments of the present disclosure, which are not intended to limit the disclosure. Though the present disclosure has been described in detail above with reference to the embodiments, those skilled in the art can still make various modifications, replacements and variations to the technical features mentioned herein. It should be understood that those replacements, modifications and variations made without departing from the spirit of the present disclosure shall fall within the scope of this application defined by the appended claims.

What is claimed is:

1. An experimental device for co-existence of overflow and lost circulation in a fractured formation during drilling of a deviated well, comprising:

a simulated deviated wellbore unit;

a computer data processing system;

a simulated formation fracture unit;

a gas injection system; and a liquid injection system;

wherein the simulated deviated wellbore unit comprises an outer pipe, an inner pipe, a joint, a drill bit, a mixture outlet, an upper overflow port, a leakage port, and a lower overflow port; an inner cavity of the outer pipe is provided with the inner pipe to form a deviated casing; the joint is arranged at an upper end of the outer pipe and an upper end of the inner pipe; a lower end of the inner pipe is provided with the drill bit; a lower end of the outer pipe is provided with a plug; an upper side of the outer pipe is provided with the mixture outlet; a middle and lower side of the outer pipe is provided with the leakage port; and a middle of the outer pipe is provided with the upper overflow port and the lower overflow port;

the simulated formation fracture unit comprises a support block, a sealing gasket, a first liquid flowmeter, a lost liquid collection tank, two clamp plates, a fracture model, and a bolt; the two clamp plates are connected through the bolt and the support block, and a gap is formed between the two clamp plates; the bolt and the support block are configured to be adjusted to change a width of the gap; the fracture model is provided in the gap, and a plurality of fractures are provided in the fracture model; the sealing gasket is provided between an upper surface of the fracture model and each of the two clamp plates; an upper side of each of the two clamp plates is provided with a first pipeline and a second pipeline; the first pipeline is connected to the lost liquid collection tank through the first liquid flowmeter, and the second pipeline is connected to the leakage port through a first back pressure valve; and an inner end of the first pipeline and an inner end of the second pipeline are respectively communicated with the plurality of fractures in the fracture model;

the gas injection system comprises an air compressor and a gas flowmeter; and an outlet end of the air compressor is connected to the upper overflow port and the lower overflow port through the gas flowmeter and a third pipeline;

the liquid injection system comprises a liquid storage tank, a water pump, a second liquid flowmeter, and a liquid regulating valve; the joint is connected with a water inlet elbow through a fourth pipeline; a top of the liquid storage tank is provided with a first connection port for liquid discharge, and a bottom of the liquid storage tank is provided with a second connection port for liquid injection; the first connection port is connected to the joint through the water pump, the second liquid flowmeter, and the liquid regulating valve; and the second connection port is connected to the mixture outlet through a gas-liquid separator;

the fracture model comprises a model shell, the plurality of fractures, a liquid outlet, a liquid inlet, and a communicating groove; the model shell has a cuboid structure, and each of the plurality of fractures is strip-shaped; an inner cavity of the fracture model is provided with the plurality of fractures and the communicating groove perpendicularly connected with the plurality of fractures; an upper wall of the model shell is provided with the liquid outlet and the liquid inlet, and the liquid outlet and the liquid inlet are respectively connected with the communicating groove;

the plurality of fractures each have a width of 1 mm, 3 mm or 5 mm; and the number of the plurality of fractures is 5, 10 or 20;

an outer wall of a fifth pipeline connected with the liquid outlet and an outer wall of a sixth pipeline connected with the liquid inlet are respectively provided with a pressure gauge;

an annular space formed between the outer pipe and the inner pipe is provided with a pressure sensor, and the pressure sensor is connected to a computer system through a signal wire;

an upper part of the joint is provided with the water inlet elbow; a lower end of the water inlet elbow is communicated with the inner pipe, and an upper end of the water inlet elbow is connected to the liquid regulating valve;

an outlet end of the gas flowmeter of the air injection system is configured to be divided into two branches; one of the two branches is connected to the upper overflow port through a second back pressure valve, and the other of the two branches is connected to the lower overflow port through a third back pressure valve; and the experimental device is configured to be operated through steps of:

(S1) opening the liquid regulating valve, and starting the water pump, so that water is pressurized by the water pump to successively fill a liquid injection pipeline, enter the inner pipe through the water inlet elbow, flow downward along the inner pipe to reach the drill bit, flow from bottom to top in the annular space formed between the outer pipe and the inner pipe, and flow out of the mixture outlet; and delivering an outflow from the mixture outlet to the gas-liquid separator for gas-liquid separation, wherein water is returned to the liquid storage tank for recycling;

(S2) after a flow pattern change in the liquid injection pipeline and a pressure change of the pressure sensor read by the computer system become stable, starting the air compressor and opening the first back pressure valve connected with the leakage port, so that gas, from the air compressor, sequentially flows through the gas flowmeter, the second back pressure valve, and the upper overflow port to enter the annular space between the outer pipe and the inner pipe, so as to simulate an overflow situation occurring on an upper side of a formation; or the gas sequentially flows through the gas flowmeter, the third back pressure valve, and the lower overflow port to enter the annular space between the outer pipe and the inner pipe, so as to simulate an overflow situation occurring on a lower side of the formation;

(S3) opening the first back pressure valve connected with the leakage port to allow a fluid in the annular space to enter the simulated formation fracture unit; wherein a type of the fracture model, the number of the plurality of fractures and width of the plurality of fractures are determined according to simulation needs, so as to simulate lost circulation situation in the formation under different fracture conditions; and the fluid eventually flows into the lost liquid collection tank;

(S4) opening the first back pressure valve, closing the second back pressure valve connected with the upper overflow port, and opening the third back pressure valve connected with the lower overflow port, so that the gas flows out of the lower overflow port to simulate a wellbore flow law and a formation lost circulation law under the co-existence of overflow and lost circulation in an upper lost circulation-lower overflow pattern;

(S5) opening the first back pressure valve, the second back pressure valve, and the third back pressure valve, such that the gas flows out from the upper overflow port and the lower overflow port, and leaks through the leakage port; obtaining, by the computer system, readings of the first liquid flowmeter, the second liquid flowmeter, the gas flowmeter, the pressure gauge, the first back pressure valve and the second back pressure valve, and analyzing a flow law and a formation lost circulation law under the co-existence of upper and lower overflow and lost circulation; and (S6) adjusting openings of the first back pressure valve, the second back pressure valve, and the third back pressure valve to simulate a flow law under the co-existence of overflow and lost circulation in different formation conditions; changing inclined angles of the outer pipe and the inner pipe and repeating the above steps to simulate a law of co-existence of overflow and lost circulation in wells with different inclined angles.

* * * * *